US005418070A

United States Patent [19]

Green

[11] Patent Number: 5,418,070

[45] Date of Patent: May 23, 1995

[54] TRI-LAYER IMPREGNATED CATHODE

[75] Inventor: Michael C. Green, Palo Alto, Calif.

[73] Assignee: Varian Associates, Inc., Palo Alto, Calif.

[21] Appl. No.: 187,100

[22] Filed: Apr. 28, 1988

[51] Int. Cl.[6] ..... B22F 7/02; H01J 29/00

[52] U.S. Cl. ..... 428/952; 428/545; 428/548; 428/550; 428/551; 428/567; 428/568; 419/2; 419/10; 419/23; 419/27; 313/364

[58] Field of Search ..... 313/346 R, 364 R; 419/27, 2, 10, 23; 428/545, 548, 551, 552, 567, 568

[56] References Cited

U.S. PATENT DOCUMENTS

| | | | |
|---|---|---|---|
| 2,700,000 | 1/1955 | Levi et al. | 117/33.26 |
| 3,373,307 | 3/1968 | Zalm et al. | 313/346 |
| 4,165,473 | 8/1979 | Falce | 313/364 R |
| 4,400,648 | 8/1983 | Taguchi et al. | 313/346 R |
| 4,417,173 | 11/1983 | Tuck et al. | 313/346 R |
| 4,459,323 | 7/1984 | Graulean et al. | 427/78 |
| 4,518,890 | 5/1985 | Taguchi et al. | 313/346 R |
| 4,570,099 | 2/1986 | Green | 313/364 R |
| 4,594,220 | 6/1986 | Hasker et al. | 419/27 |
| 4,625,142 | 11/1986 | Esdouk et al. | 313/346 DC |
| 4,675,570 | 6/1987 | Green | 313/364 R |
| 4,833,361 | 5/1989 | Suzuki et al. | 313/346 R |
| 4,873,052 | 10/1989 | Hasker et al. | 419/27 |
| 4,893,052 | 1/1990 | Tanabe et al. | 313/364 R |
| 4,994,709 | 2/1991 | Green et al. | 313/310 |
| 5,006,753 | 4/1991 | Hasker et al. | 313/364 R |
| 5,266,414 | 11/1993 | Goeser et al. | 428/545 |

*Primary Examiner*—Donald P. Walsh
*Assistant Examiner*—John N. Greaves
*Attorney, Agent, or Firm*—Peter J. Sgarbossa

[57] ABSTRACT

An impregnated cathode comprising three layers: a very thin emitting surface layer of metal such as an alloy of tungsten with a high fraction of an activating metal of the platinum group to provide low workfunction; an underlying, thin buffer layer of porous tungsten alloyed with a fraction of activating metal, to retard diffusion loss of activating metal from the emitting layer; and a substrate of porous tungsten impregnated with barium aluminate.

19 Claims, 1 Drawing Sheet

TRI-LAYER IMPREGNATED CATHODE

Development of this invention was funded by Rome Air Development Center of the U.S. Air Force under Contract No. F-30602-82-C-0069

FIELD OF THE INVENTION

The invention pertains to thermionic cathodes of a sintered, porous tungsten matrix impregnated with molten barium aluminate.

PRIOR ART

The basic impregnated cathode is described in U.S. Pat. No. 2,700,000 issued Jan. 18, 1955 to R. Levi. A porous body is formed by pressing tungsten powder, sintering to form a solid porous body, impregnating the pores with a liquid such as molten copper, converting the liquid to a solid as by freezing the copper, machining the impregnated cathode body to desired shape, removing the impregnant as by evaporation or chemical solution, and impregnating the body with barium aluminate. The aluminate is used instead of simple barium oxide because it can be infused in a molten state.

A further improvement is described in U.S. Pat. No. 3,373,307 issued Nov. 12, 1964. This is a thin layer of a platinum-group metal such as osmium, iridium, rhenium, ruthenium on the emitting surface. This results in a lowered work function which permits higher emission and/or lower temperature operation. This improvement was of limited life, later found to be due to the diffusion of the activating metal to alloy with the tungsten substrate, and to sputtering it away by bombardment with positive ions formed by collisions of the accelerated emission electrons with residual gas in the electron-discharge device.

U.S. Pat. No. 4,165,473 issued Aug. 21, 1979 to Louis R. Falce and assigned to the assignee of the present invention, discloses a cathode in which particles of iridium or the like are dispersed among the tungsten particles of the matrix. During sintering the iridium partially alloys with the tungsten. This dispersed cathode solved the problem of surface sputtering. It has been found, however, that the sintering is a very delicate process. If the time and temperature are enough to get a lot of alloying, the emission is often poor. If the sintering is held to a minimum, the emission is initially good, but interdiffusion of iridium and tungsten occurs at operating temperature to form unreactive alloy. This in turn causes the barium supply to the surface to fall off with a resultant decay in emission. Also, shrinkage of the cathode button can take place with the distortion of the emitting surface, which impacts adversely on the electron optics of the gun.

This structure has two basic disadvantages: The platinum-group metals are not as active as pure tungsten in reducing barium oxide to form the metallic barium which diffuses to the surface and activates the emission. Also, these metals are very expensive and to incorporate them in the bulk of the cathode greatly increases the cost.

Proposals have been made to incorporate platinum-group metals only in a surface layer of the body. These have had problems with fabrication. The body shrinks during sintering so the final geometry is distorted and machining down to an affordable amount of activating metal is barely possible.

Other prior art described in U.S. Pat. No. 4,675,570 issued Jun. 23, 1987 to Michael C. Green is to include, in an iridium-alloy matrix, islands of pure tungsten, large enough to resist alloying, to provide increased reducing of barium oxide. The rest of the matrix remains a relatively poor reducing medium, while the islands provide the barium supply.

Throughout this specification, a preferred embodiment of the invention is described. The materials described are only representative of the true scope, which encompasses other similar materials. The word "tungsten" shall be used to include other moderately active refractory metals and alloys, such as molybdenum. The word "osmium" includes other metals of the group consisting of osmium, platinum, iridium, rhenium and ruthenium. The word "barium" includes other alkaline earths and mixtures, such as calcium and strontium.

SUMMARY OF THE INVENTION

An object of the invention is to provide an impregnated cathode of improved emission and life.

Another object is to provide a cathode of low cost.

A further object is to provide a cathode with reproducible characteristics.

These objects have been realized by a cathode whose metallic framework comprises three different layers: an emitting surface layer containing a large percentage of osmium, an underlying buffer layer containing a comparable percentage of osmium, and a substrate of pure tungsten.

A process for producing this structure cheaply and reliably comprises removing the processing impregnant from the tungsten matrix to the depth of the buffer layer, depositing osmium in the buffer layer, removing the rest of the processing impregnant and impregnating the entire body with barium aluminate, and depositing an osmium-rich emitting layer on the surface.

DESCRIPTION OF THE PREFERRED EMBODIMENTS

The invention can best be understood by combining the description of the complete structure with the process of making it, because they are intimately interrelated.

The main body of the cathode is a substrate 10 made by the process well-known in the art. Tungsten particles 12 (FIG. 1) are compacted into a porous mass by isostatic pressing.

I have found it preferable to have particles 12 all about the same size, which may be done by selective settling or sieving. This gives greater porosity for diffusing barium to the cathode surface through the larger pore spaces and also more volume of impregnant for a greater supply of impregnating oxide. A range of 2:1 or less in particle size is beneficial.

The mass is fired in hydrogen at a high temperature to sinter particles 12 together to form a rigid matrix billet with interconnecting pores 14. The matrix shrinks during sintering. The billet is too brittle to be machinable. The pores 14 are infiltrated with molten copper which is frozen to form a machinable body. Alternatively, the process impregnant may be a liquid organic monomer which is heated to polymerize into a solid body. For the inventive cathode process, I have found that the copper impregnant is preferable.

Figure 1:
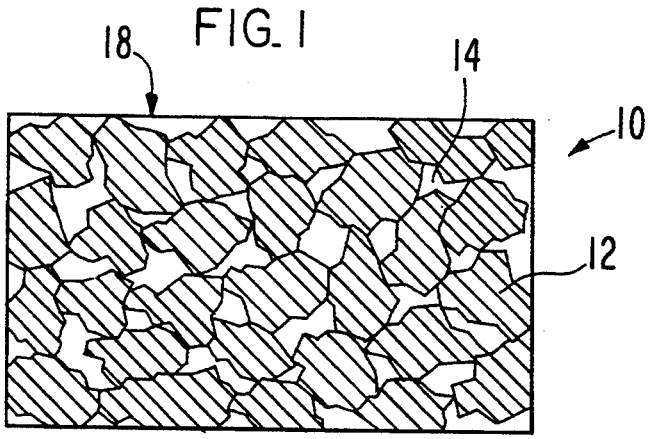
FIG. 1 is a schematic axial cross-section of the 3-layer cathode.

The billet is then machined to the shape of the final cathode body 10 (FIG. 1). In the prior art, the process impregnant was removed by firing or etching and the entire cathode was then impregnated with molten barium aluminate.

Figure 2:
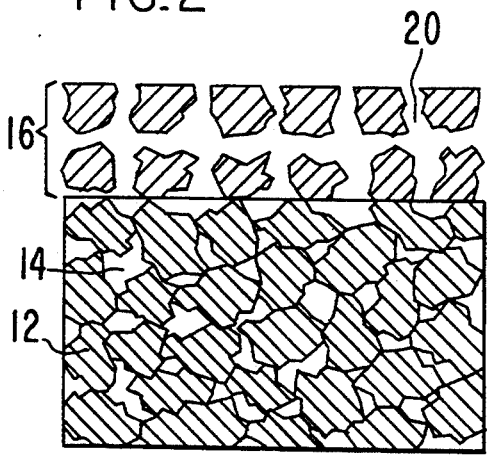

In my inventive cathode, substrate 10 is preferably of pure tungsten to provide adequate reduction of barium oxide. A buffer layer 16 (FIG. 2) is formed next to the emitting surface 18. Buffer layer 16 is preferably between 0.01 and 0.1 mm thick to provide low enough resistance to diffusion of barium from substrate 10 to activate the emitting surface. Buffer layer 16 is preferably formed from the body matrix by chemical processing. The process impregnant is removed from the pores 14 by chemical etching or dissolving to the required depth. For copper impregnant dilute nitric acid is satisfactory. In this way the thickness of buffer layer 16 is controlled and made uniform over the cathode emitting surface, regardless of its shape, which is usually concave to produce a convergent beam.

In a preferred embodiment, pores 20 in buffer layer 16 are made larger than pores 14 in substrate 10 (FIG. 2) to provide space for the infiltration of the addition of platinum group metal without blocking the pores, which would impede the diffusion of barium to the emitting surface. This is done by a chemical etchant which selectively dissolves the tungsten and not the process impregnant. Murakami's etch may be used.

The buffer layer 16 is composed of a tungsten-osmium alloy. The active metal may be deposited in the pores from a volatile compound such as osmium tetroxide. A reducing agent such as paraformaldehyde may be previously deposited in the buffer-layer pores to reduce the volatile oxide to an active metal deposit. During subsequent high-temperature firing, the active metal alloys with the tungsten particles.. The purpose of the osmium-rich alloy is to retard the diffusion of osmium away from the surface emitting layer. I have found that osmium diffuses readily into pure tungsten. However, the osmium in the alloy retards the in-diffusion of more osmium from the emissive surface layer.

After buffer layer 16 is formed, the remaining process impregnant is removed from substrate pores 14 by chemical solution or high-temperature vaporization.

Figure 3:
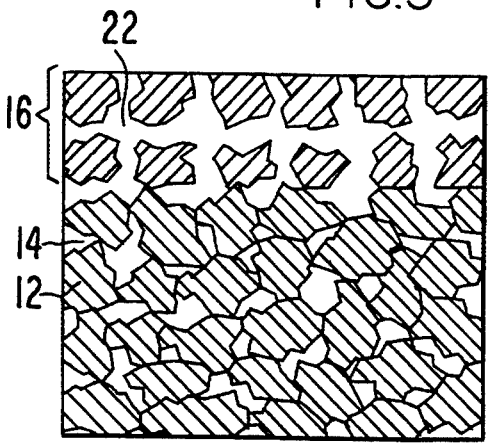

The entire cathode body is then impregnated with molten barium aluminate 22, which provides the emission-activating barium and barium oxide (FIG. 3).

Figure 4:
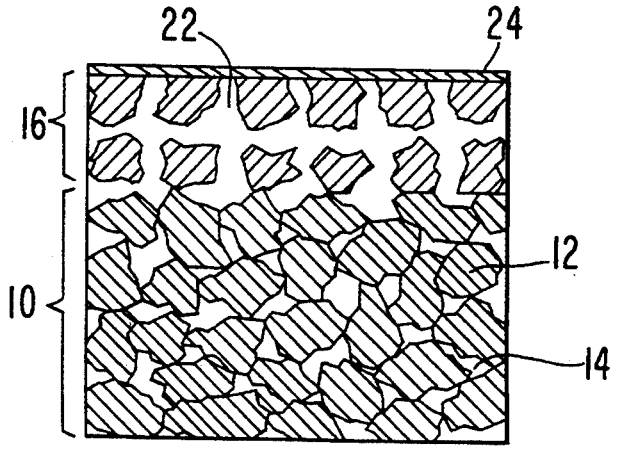
FIGS. 2–4 are a series of schematic sections illustrating steps in the production process.

The final cathode layer is a thin surface layer 24 (FIG. 4) composed of an alloy of about 50% osmium and tungsten. I have found that this composition provides optimum emission, but alloys in the range between 40% and 60% osmium are good, and over 22% are still satisfactory. Surface layer 24 is preferably produced by atomic deposition, as by sputtering the pre-mixed alloy. The thickness of surface layer 24 should be thick enough to resist depletion during operating life by gas sputtering and any residual diffusion loss of osmium. A thickness of about one micron is desirable. Between 0.1 and 10 microns provides good performance for emission and life. The maximum thickness is limited by the dense layer becoming impervious to the diffusion of barium from the impregnant to the emitting surface.

The above-described cathode and process of manufacture are illustrative of a preferred embodiment and not intended to be limiting. Considerable differences of dimensions and materials are possible to meet a range of requirements such as operating life, emission density, and vacuum conditions in the completed electron discharge device. The scope of the invention is to be limited only by the following claims and their legal equivalents.

What is claimed is:

1. An impregnated cathode comprising:

a porous matrix substrate of sintered particles of refractory metal of the group consisting of tungsten and molybdenum;

an emitting surface layer containing at least 22% of activating metal of the group consisting of iridium, osmium, rhenium and ruthenium;

a porous buffer layer below said emitting layer whose metallic part contains a percentage of said activating metal comparable to said active layer; and the pores in said matrix and buffer layer impregnated with an alkaline earth aluminate.

2. The cathode of claim 1 wherein said emitting layer contains between 40% and 60% of said activating metal.

3. The cathode of claim 1 wherein the remainder of said emitting layer is said refractory metal.

4. The cathode of claim 1 wherein the remainder of said buffer layer is said refractory metal.

5. The cathode of claim 1 wherein said pores of said buffer layer are larger than the impregnated pores of said substrate.

6. The cathode of claim 1 wherein said emitting layer is between 0.1 and 10 microns thick.

7. The cathode of claim 1 wherein said buffer layer is between 0.01 mm and 0.1 millimeters thick.

8. The cathode of claim 1 wherein said refractory particles are of dimensions within a range of 2:1.

9. The cathode of claim 1 wherein said emitting layer is a dense deposited layer.

10. The cathode of claim 1 wherein said activating metal is osmium.

11. The cathode of claim 1 wherein said refractory metal is tungsten.

12. A process for making the cathode of claim 1 comprising the steps of:

sintering particles of refractory metal of the group comprising tungsten and molybdenum to form a porous matrix;

impregnating said matrix with a liquid;

converting said liquid to a solid process impregnant;

machining said mass to the desired shape of said cathode;

selectively removing said solid process impregnant from a buffer layer of said cathode shape which is to be directly beneath the emitting surface;

depositing in the buffer-layer pores whence said impregnant was removed, activating metal of the group consisting of iridium, osmium, rhenium and ruthenium;

impregnating said cathode shape with alkaline earth aluminate;

coating said emitting surface with an emitting layer rich in said activating metal.

13. The method of claim 12 wherein after removing said process impregnant from said buffer layer, said empty pores are enlarged by chemical etching.

14. The process of claim 12 wherein said emitting layer contains at least 22% activating metal.

15. The process of claim 12 wherein the amount of activating metal deposited in said buffer layer is sufficient to make the metallic activating metal concentration in the portion of said buffer layer comparable to that of said emitting layer.

16. The process of claim 12 wherein the thickness of said buffer layer is between 0.01 and 0.1 mm.

17. The process of claim 12 wherein said emitting layer is between 0.1 and 10 microns thick.

18. The process of claim 12 wherein said buffer layer is between 0.01 and 0.1 millimeters thick.

19. The process of claim 12 wherein said emitting layer contains between 40% and 60% of said activating metal.

* * * * *